United States Patent [19]

Barrett, II

[11] Patent Number: 4,676,561

[45] Date of Patent: Jun. 30, 1987

[54] COMBINATION PERSONNEL AND GARMENT GROUNDING STRAP

[75] Inventor: Joe H. Barrett, II, Antioch, Tenn.

[73] Assignee: Blue Bell, Inc., Greensboro, N.C.

[21] Appl. No.: 800,772

[22] Filed: Nov. 22, 1985

[51] Int. Cl.[4] ..... H01R 4/66

[52] U.S. Cl. ..... 439/37; 361/220; 439/108

[58] Field of Search ..... 339/11, 14 R; 361/220, 361/223

[56] References Cited

U.S. PATENT DOCUMENTS

| | | | |
|---|---|---|---|
| 3,596,134 | 7/1971 | Burke | 361/220 |
| 3,857,397 | 12/1974 | Brosseau | 361/220 X |
| 4,475,141 | 10/1984 | Antonevich | 361/220 |
| 4,577,256 | 3/1986 | Breidegam | 361/220 X |
| 4,596,053 | 6/1986 | Cohen et al. | 361/223 X |

*Primary Examiner*—Eugene F. Desmond

*Attorney, Agent, or Firm*—Charles R. Rhodes; Judith E. Garmon

[57] ABSTRACT

Personnel and their garments are grounded through a uniquely designed, common body/garment strap which includes:

an elastic closed loop fabric member having an elastic tab extending therefrom;

conductive yarns in both the closed loop member and its extension;

the elastic extension or tab electrically connected to the garment; and the closed loop member connected to ground.

Thus, both the garment and operator are grounded, while the elastic conductive tab allows freedom of movement of the garment with respect to the operator's body.

4 Claims, 2 Drawing Figures

COMBINATION PERSONNEL AND GARMENT GROUNDING STRAP

BACKGROUND AND SUMMARY OF THE PRESENT INVENTION

This invention relates generally to static dissipative devices, and more particularly to a static dissipative wrist strap which simultaneously grounds the body of an operator and his/her static electricity generating garment.

In industry today, certain sensitive electronic components, such as integrated circuits and associated components are extremely susceptible to damage from static electricity. While the human body cannot even feel static electricity at levels less than 3,000 volts, a static electricity charge of as little as 100 volts can damage or even destroy sensitive electronic components. In the industrial environment, it is well known that static electricity can be generated or built up in two ways, i.e. in the human body itself, or in certain garments, especially those made from wool, silk, and synthetic fibers. Even cotton, in low humidity situations, can cause static build up of sufficient levels to cause damage or destruction to sensitive electronic components.

The cost of damage and rework on electronic components and circuits due to the discharge of static electricity has been estimated at five hundred million dollars per year by some experts. Other experts believe an annual potential of five billion dollars can be saved by the elimination of static-related damage. If damage as a result of static electricity is discovered at the chip stage, it is relatively inexpensive to replace. If it is discovered at the board stage (assembled chips) the cost may be from $15–$30. If the damage is not discovered until the defective component is incorporated into a piece of machinery, the cost can run into thousands of dollars, or even worse can lead to product failure.

Awareness and recognition of the scope of the potential damage from static electricity is a large part of the problem. While an employee cannot feel a 1,000 volt static discharge, or see it, hear it, smell it, or taste it, such a relatively undetectable static discharge can cause a very large number of electronic component failures. The attack on this problem must be two-fold, as both the operator and the garments which he wears must be grounded. As far as the garments are concerned, there have been some attempts to apply topical treatments onto laboratory coats or jackets to dissipate static electricity. Such treatments are not completely satisfactory because the treatment may be easily lost by laundering, and it is not believed that topical treatments can effectively maintain a conductivity such the resulting resistance of the fabric is low. Recently, conductive fabrics have been developed which are woven from a blend of fibers containing polyester, cotton, and steel. This fabric is classed as static dissipative and can be grounded to effectively dissipate static electricity and prevent damage.

Further, conductive wrist straps have been developed, such as those illustrated and described in U.S. Pat. Nos. 4,398,277; 4,459,633; and 4,475,141. Such wrist or ankle straps are of a conductive material and drain the body's static electricity to ground. The aforementioned static dissipative apparel has, in general, been a parallel system which is not positively grounded (by grounding wires) unless the garment is in contact with a grounding device such as a properly grounded conductive chair.

Recently the practice of snapping the cuff of the static dissipative garment to a complementary snap on the wrist band has been introduced and is being used somewhat in industry today. The disadvantage here is that the snapping of the cuff directly to the wrist band restricts the movement of the sleeve and the movement of the individual.

The present invention provides an elasticized conductive tab between the wrist band and garment which grounds the garment as is necessary through the same grounding mechanism as that which grounds the operator. This approach allows for greater freedom of movement by the wearer.

Therefore, in accordance with the present invention, in general there is provided a conductive body strap for simultaneously electrically connecting both the operator and an overlying garment to electrical ground. The body strap includes a stretchable band of elastomeric fabric adapted to elastically embrace a body member such as the wrist, ankle, waist, or otherwise in a closed loop. The stretchable band has an inner and outer surface with one or more conductive yarns extending along at least the inner surface in electrical contact with the body member which it encircles. A tab formed of an elastomeric fabric extends outwardly from the closed loop and also includes one or more conductive yarns therein connected to the conductive yarns in the closed loop. A first coupling means, such as a snap adjacent free end the of the tab, electrically connects the conductive yarns in the tab to the conductive yarns in the garment, and a second coupling means electrically connects the conductive yarns in the band through an electrical cable to ground.

In the more preferred embodiments, both the body strap and extension are formed of a single length of the same type of conductive, elastomeric fabric with the first coupling means at one end thereof. The other end of the fabric length is formed into a loop and attached to an intermediate point to form the band. All couplings may be metallic snap systems.

It is therefore an object of the present invention to provide a conductive body strap which simultaneously electrically connects the body of an operator and the garment which he is wearing to electrical ground.

Another object of the invention is to provide a conductive body strap of the type described which includes an elastomeric conductive strap encircling the wrist or ankle and includes an elastic extension which is electrically connected to the cuff of an overlying garment.

Other objects and a fuller understanding of the invention will become apparent from reading the following detailed description of a preferred embodiment in which:

FIG. 1 is a perspective view illustrating the wrist strap of the present invention in operative engagement with the arm of an operator; and FIG. 2 is a plan view of the wrist strap illustrated in FIG. 1, but removed from the arm of the operator.

DETAILED DESCRIPTION OF A PREFERRED EMBODIMENT

Figure 1:
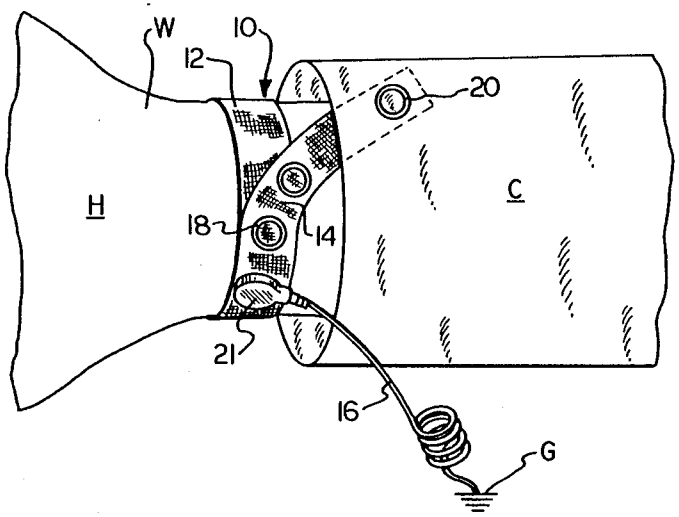

Turning now to the drawings, and particularly to FIG. 1, there is illustrated the body strap 10 according to the present invention. A stretchable band 12 of elastomeric fabric elastically embraces the wrist W of a body member, further including a hand H clothed in some type of garment having a cuff C. The band 12 is formed into a closed loop and secured by snap means 17,18, and includes an inner face adjacent the wrist W and an outer face on the opposite side thereof.

The stretchable band 10 of elastomeric fabric 13 further includes one or more conductive yarns 11 incorporated therein extending along at least the inner surface thereof in electrical contact with wrist W. This stretchable fabric with the conductive yarns on the surface thereof is commercially available from Offray Industrial Narrow Fabrics, a Division of C. M. Offray and Son, Inc., of Chester, N.J. The fabric is referred to as the Offray Conductive Wrist Band Fabric. An alternate fabric is illustrated and described in U.S. Letters Pat. No. 4,398,277 to Christiansen et al.

A tab or extension 14 extends outwardly from the closed loop. While extension 14 is preferably of the same elastic conductive fabric as the closed loop 12, this is not absolutely essential, as the fabric of the extension 14 might be different, as long as the conductive yarns therein were connected to the conductive yarns in the closed loop 12.

The end of the elastic extension 14 includes a male coupling member 19 or snap which is selectively engagable with a female coupling member 20 or snap secured adjacent the end of cuff C. So arranged, the cuff is relatively free to slide up and down the operator's arm because of the elasticity of extension 14, rather than being secured to the closed loop 12 itself.

A grounding cable 16 is electrically coupled to the closed loop 12 through a second coupling means 21,22, which electrically connects the conductive yarns in the band 12 to ground G.

Figure 2:
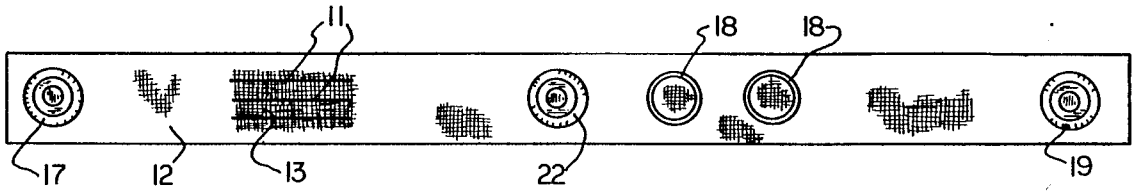

Looking now at FIG. 2, the outer face of conductive strap 10 is illustrated in the disc assembled form. The band or ribbon 12 includes a plurality of male snap members 17,19, and 22 secured to the outer face of the band 12. A pair of female snap members 18 are secured to and accessible from the inner side of band 12 as illustrated in FIG. 2. In order to form the closed loop, the left hand end of the band 12 is formed into a loop with the male snap member 17 inserted into one of the two female snap members 18 around the wrist of the operator. The male snap member 19 at the opposite end of band 12 is snapped into the female coupling member in cuff C. The section of the band 12 between the point at which the male snap 17 is attached to one of female snaps 18 and the male snap member 19 forms the stretchable tab or extension 14. The female snap member 21 on the end of cable 16 is then secured to male snap member 22 on band 12 to connect the grounding cable 16 thereto.

While the embodiment illustrated in FIGS. 1 and 2 allows a single size wrist band to fit various wrist sizes, the left hand end of the band (FIG. 2) may be permanently secured to the intermediate portion as by sewing or insertion between the mechanical elements of the male snap member 22. In such case, the grounding strap should be made available in two or three sizes.

While the invention is illustrated in FIG. 2 as being attached to the wrist of an operator, it is obvious that it could be attached to the ankle, or even around the waist, so long as the inner surface of the stretchable band engages the skin of the operator and the stretchable tab is in conductive contact with the adjacent conductive garment. Further, the manner in which the conductive yarns are interlaced, woven, knitted, or otherwise incorporated into the fabric of the stretchable band 12 is immaterial, so long as the conductive yarns are exposed to at least a portion of the inner surface thereof for contact with the skin of the operator.

While a preferred embodiment of the invention has been shown and described in detail hereinabove, it is apparent that various changes and modifications might be made without departing from the scope of the invention which is set forth in the accompanying claims.

What is claimed is:

1. A conductive body strap for simultaneously electrically connecting personnel and an overlying garment to electrical ground comprising:

(a) a stretchable band of elastomeric fabric adapted to elastically embrace a body member in a closed loop, said band having inner and outer surfaces;

(b) one or more conductive yarns interlaced in and extending along at least a portion of said inner surface for electrical contact with the skin of said body member;

(c) said stretchable band including a stretchable elastic tab formed of an elastomeric fabric and extending outwardly from said closed loop, said tab also including one or more conductive yarns interlaced therein connected to the conductive yarns in said stretchable band;

(d) a first coupling means adjacent the end of said tab for electrically connecting the conductive yarn(s) in said tab to said garment; and (e) a second coupling means for electrically connecting said conductive yarn(s) in said band through an electrical cable to ground.

2. The conductive body strap according to claim 1 wherein said stretchable band and said stretchable tab are formed from a single ribbon of said elastomeric conductive fabric.

3. The conductive body strap according to claim 2 wherein said first coupling means comprises a male snap member at one end of said ribbon which is selectively engagable with a female snap member on said body garment; said second coupling means comprises a male snap member secured to an intermediate portion of said ribbon which is selectively engagable with a female snap member secured to a ground cable; and the other end of said band including a male snap member selectively engagable with a female snap member secured to the intermediate portion of said band to form said closed loop.

4. The conductive body strap according to claim 3 wherein said couplings are metallic snaps.

* * * * *